US005462601A

United States Patent [19]

Falcoff et al.

[11] Patent Number: 5,462,601

[45] Date of Patent: Oct. 31, 1995

[54] AUTOMATED TEST PANEL SPRAY/BAKE DEVICE

[75] Inventors: Allan F. Falcoff, Chadds Ford, Pa.; James A. Delano, Grand Blanc, Mich.; Robert E. Albers, Wilmington; Robert C. Jankowski, Newark, both of Del.

[73] Assignee: E. I. Du Pont de Nemours and Company, Wilmington, Del.

[21] Appl. No.: 88,968

[22] Filed: Jul. 7, 1993

[51] Int. Cl.[6] ..... B05B 12/02

[52] U.S. Cl. ..... 118/697; 118/698; 118/58; 118/313

[58] Field of Search ..... 118/696, 697, 118/698, 313, 314, 315, 322, 58, 64, 66

[56] References Cited

U.S. PATENT DOCUMENTS

| | | | |
|---|---|---|---|
| 3,921,576 | 11/1975 | Vertue | 118/634 |
| 4,327,665 | 5/1982 | Aviasmuth | 118/64 |
| 4,614,300 | 9/1986 | Falcoff | 239/71 |
| 4,635,381 | 1/1987 | Hubbert | 34/54 |
| 4,949,665 | 8/1990 | Weber | 118/322 |
| 5,005,514 | 4/1991 | Verrico | 118/313 |
| 5,032,052 | 7/1991 | Swain | 414/222 |
| 5,153,034 | 10/1992 | Telchuk et al. | 118/326 |
| 5,178,679 | 1/1993 | Josefsson | 118/309 |
| 5,205,869 | 4/1993 | Ahern | 118/326 |

*Primary Examiner*—James C. Housel
*Assistant Examiner*—Rachel Heather Freed
*Attorney, Agent, or Firm*—James T. Corle

[57] ABSTRACT

A device for spraying and baking panels within a single automated unit. The spray booth and baking environment are differentially pressurized and purged such that the unit can be located with an environment which is electrically classified as hazardous for flammable materials. Parameters unique for processing materials to be used are programmed into a control computer. Mounted within the spray chamber is an emissions reduction attachment which collects paint and wash liquids used in purging the spray gun during the spray cycles. Significant increase in the useful life of materials collecting paint overspray and a decrease in airborne emissions can thereby be achieved.

11 Claims, 2 Drawing Sheets

AUTOMATED TEST PANEL SPRAY/BAKE DEVICE

FIELD OF THE INVENTION

The present invention is related generally to paint spraying machines, especially those utilized to prepare samples that can be used as paint standards. More particularly, the invention relates to an automated device which integrates a spray machine within a spray booth with a bake module and an emissions reduction device.

BACKGROUND OF THE INVENTION

Spray machines are well known in the paint industry for spraying objects along assembly lines. Such devices are also used to prepare painted panels to serve as reference standards. Other panels are compared against such reference panels, and if there is a color or other quality discrepancy, the batch of paint under analysis via the test panel will be modified accordingly.

A typical spray machine uses a spray gun with drive means that are capable of being set to control horizontal and vertical movement of the gun and/or panels, as well as the speed of the gun. Other variables of the spray machine capable of being set include the number of passes of the gun (related to paint fan spray pattern of the gun), the flash period (to allow solvent evaporation), the width of the spray stroke, the number of coats of paint, and the like.

DESCRIPTION OF RELATED ART

Any particular paint will have unique spray characteristics and the spray machine must be set accordingly so that spray time, gun traverse velocity, flash interval time, vertical panel indexing, etc., are compatible with the paint being sprayed. Such variables can be set manually, requiring extensive time. Parameters can also be set using a spray machine which is controlled automatically by a computer system which allows diverse spray procedure to be quickly and easily selected, e.g., Falcoff, U.S. Pat. No. 4,614,300, issued Sep. 30, 1986.

Typically, during manufacture of a batch of paint, a sample of the paint is sent to a control laboratory for spraying and baking to be used as a comparison against a reference panel to determine color modifications to be made to the batch. This procedure typically can take up to twelve hours to complete, with possible iterations of the testing cycle if multiple color modifications to the batch are necessary. This is a time consuming, albeit necessary, procedure in the manufacture of paint.

The problems experienced heretofore are obviated by the present invention, in which a test panel spray machine, a spray booth and a baking module are combined into a novel automated device. The device is suitable for placement in a Class 1, Division 2, Group C/D electrically classified environment as defined in Article 500 of the National Electrical Code Handbook. The device is compact and can be conveniently located on the manufacturing floor, adjacent to equipment used for manufacturing paint, permitting the manufacturing operator to use the device immediately after a batch of paint has become homogenous after a shading hit has been made to the batch.

The spray and bake cycles are controlled by a programmable logic controller. The spraying and baking cycles are designed to allow multiple sprayout and bake cycles to be performed using two spray guns. Parameters for the spraying and baking cycles can be programmed into the device and can be varied for each batch.

The spray gun used in the coating cycle is purged with paint to be sprayed before the spray cycle is initiated and then purged with wash liquid upon completion of the spray cycle. Prior to this invention, paint and wash liquid is simply sprayed into the booth, with the paint arrestor capturing the spray and associated vapors are carried into the exhaust air handling system.

In the present invention, the spray gun is positioned by a emissions reduction attachment and purge paint and wash liquids are ejected directly into it after the atomization air to the spray gun has been deactivated. This funnel-shaped device is connected to a container outside the spray booth which collects the waste material for disposal. By minimizing the amount of material going onto the paint arrestor, the useful life of the paint arrestor is increased. There is also a significant decrease in the amount of vapors being carried into the exhaust air handling system, decreasing the amount of emissions which must be treated upon exit from the from the spray booth.

The present invention makes it possible to use production operators who are not trained in precision spray techniques in the preparation of laboratory quality sprayouts within a factory environment.

Another advantage provided by the present invention is a significant decrease in the overall time required to prepare a sprayed panel. Major time reduction can be achieved when the spraying, flashing and baking are performed without intermediate operator interference. This is particularly significant for a waterborne basecoat with a solvent borne clearcoat system where an intermediate bake is required between the basecoat and the clear topcoat.

Still another advantage is the increase in useful life of the paint arrestor within the spray booth with an associated decrease in material being collected during the spray process. In addition, there is a decrease in the amount of vapors being exhausted into the air handling system, decreasing the amount of emissions from the spray booth.

SUMMARY OF THE INVENTION

An apparatus for preparing paint samples, which utilizes the following elements:

(a) an enclosed spray booth having entry means for introducing a panel and means for positioning said panel in said booth, (b) a spray gun mounted in a spraying zone and heating elements mounted in a baking zone, (c) means for moving said spray gun and said panel in relationship to each other to apply a programmed spray coating to said panel, (d) means for advancing a coated panel from said spraying zone into said heating zone, (e) said spray gun and said heating elements being programmed to automatically perform spraying and baking cycles, and (f) computer means for controlling coating flow to said gun and for actuating, monitoring and correcting parameters of movement and coating flow to said gun and movement of said panel within said spray booth.

DETAILED DESCRIPTION OF THE INVENTION

Figure 1:
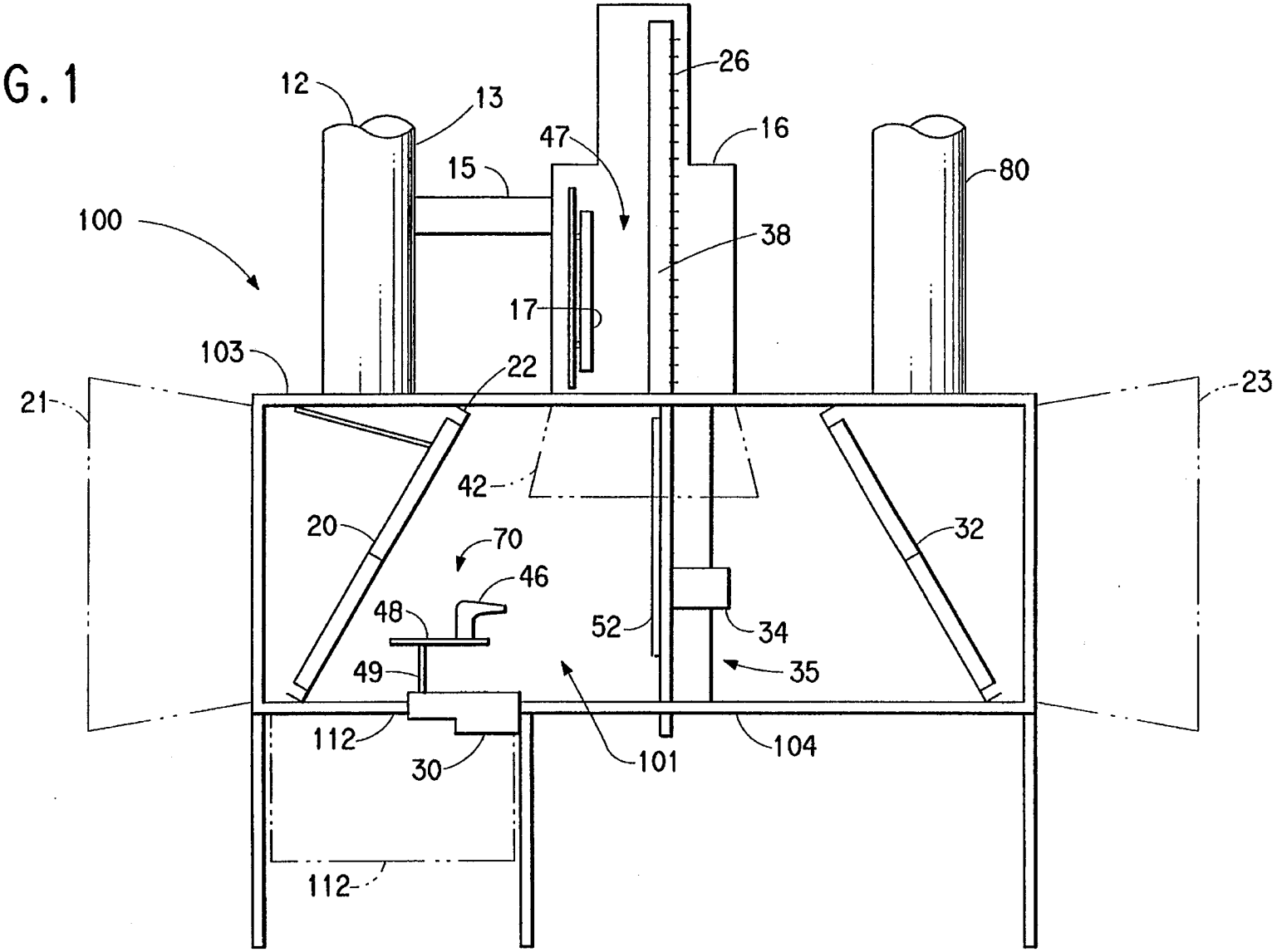
FIG. 1 is a schematic representation illustrating the major components of the present invention.
Figure 3:
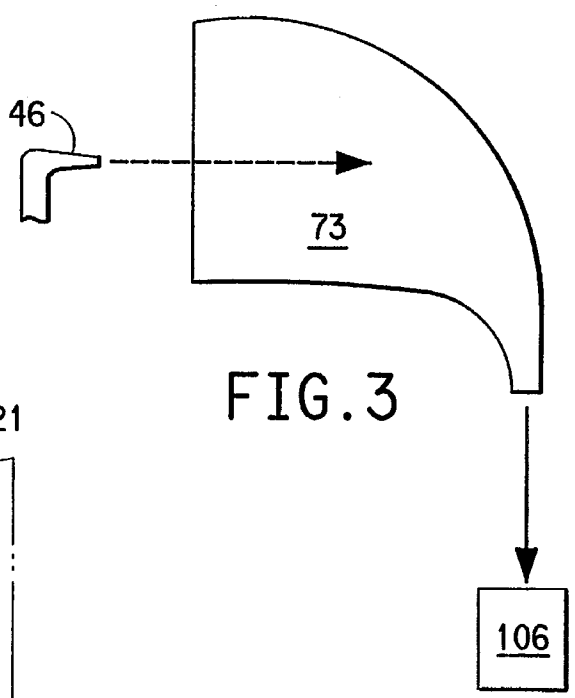
FIG. 3 is a schematic representation of an emissions reduction attachment located within the spray booth cavity.

As shown in FIG. 1, spray booth 100 has a front well in the form of hinged doors 21, rear doors 23, top 103, and bottom 104, with split floor plates 112 that hinge to each side, allowing an operator to enter the face of the booth up to spray gun traversing mechanism 30. Spraying is completed within booth cavity 101. Booth cavity 101 is maintained at an air pressure lower than ambient to ensure that spray does not enter the ambient environment.

Air intake unit 12, with associated heating, cooling and humidification means, conditions air which is temperature and humidity controlled through high quality filters into booth cavity 101 through duct 13. Air flows through filter/diffuser assembly 20, attached to top 103 by means of hinge 22. The filter/diffuser assembly consists of a frame and a filter which filters the incoming air from duct 13 and diffuses the air stream as it continues into booth cavity 101. To the rear of booth cavity 101 paint arrestor 32, consisting of paint arresting media, such as Devilbiss Model DF-9768-K20, available from Devilbiss-Ransburg Co., Maumee, Ohio, and an arrestor frame assembly, collects overspray from the air stream as it proceeds to enter exhaust air handling system 80. Air bleed 15 is ducted from the intake air unit 12 to oven assembly 16.

Within spray booth cavity 101 is spray gun 46. Up to two spray guns are mounted on horizontal gun bar 48, which is in turn, mounted on vertical bar 49. Vertical bar 49 is driven by a horizontal drive system, not shown, which is powered by a servo motor, not shown.

Vertical indexing assembly 35 is controlled by servo motor 34. Dymatrol® mechanical drive tape 26 is linked through a cog, not shown, on servo motor 34 through tape shroud 38 to drive vertical indexing assembly 35 on an associated track. Rotation by servo motor 34 is translated into vertical motion of panel support frame 52 to which test panels to be sprayed by spray gun 46 are releasably attached.

Oven assembly 16 is separated from booth cavity 101 by oven flap doors 42 which are driven by pneumatic cylinders, not shown. Flap doors 42 isolate oven chamber 47, which is pressurized, from spray booth cavity 101 while oven assembly 16 is in operation. Spray booth 100 is maintained at a slightly lower pressure than the pressure of oven chamber 47, ensuring that no flammable vapors enter oven chamber 47 while oven chamber 47 is in operation. Oven chamber 47 is purged to remove flammable material prior to activating heating elements within oven assembly 16. Purging is performed by supplying clean air at a sufficient flow and positive pressure, through air blood 15 to reduce to an acceptable level the concentration of any flammable gases present within the enclosure. In this invention, Type X purging is used, defined by Article 500 of The National Electrical Code Handbook as reducing the classification within an enclosure from Division I to nonhazardous. The air pressure within oven chamber 47 is maintained at a level higher than that of the surrounding ambient air, which, in turn, is higher than the level of air pressure maintained within spray booth cavity 101. These differential pressures ensure that hazardous or flammable vapors are contained within spray booth cavity 101. Differential air pressures are maintained through control of the air flow through air intake unit 12 and exhaust air handling system 80 by varying the motor speed of their respective blower fans.

Prior to use, spray parameters are entered into the memory of an attached computer 116, such as an Allen-Bradley Model PLC 5/25 Programmable Logic Controller available from Allen Bradley Co., Milwaukee, Wis., and cross-referenced by a method name. Each procedure typically contains information for gun traverse speed, gun-on distance, interpass dwell time, flash time between coats, vertical index distance between gun passes, number of coats to be applied, bake temperature, bake time and cooling time. The computer can be programmed to apply a basecoat only, a basecoat and clearcoat sprayout combination or a clearcoat sprayout only.

Basecoat paint, basecoat wash, clearcoat paint and clearcoat wash solutions are contained in individual pressure pots. All pots are closed and pressurized to pre-determined pressures prior to use. Variable speed motor driven metering pumps can be used instead of pressure pots.

Figure 2:
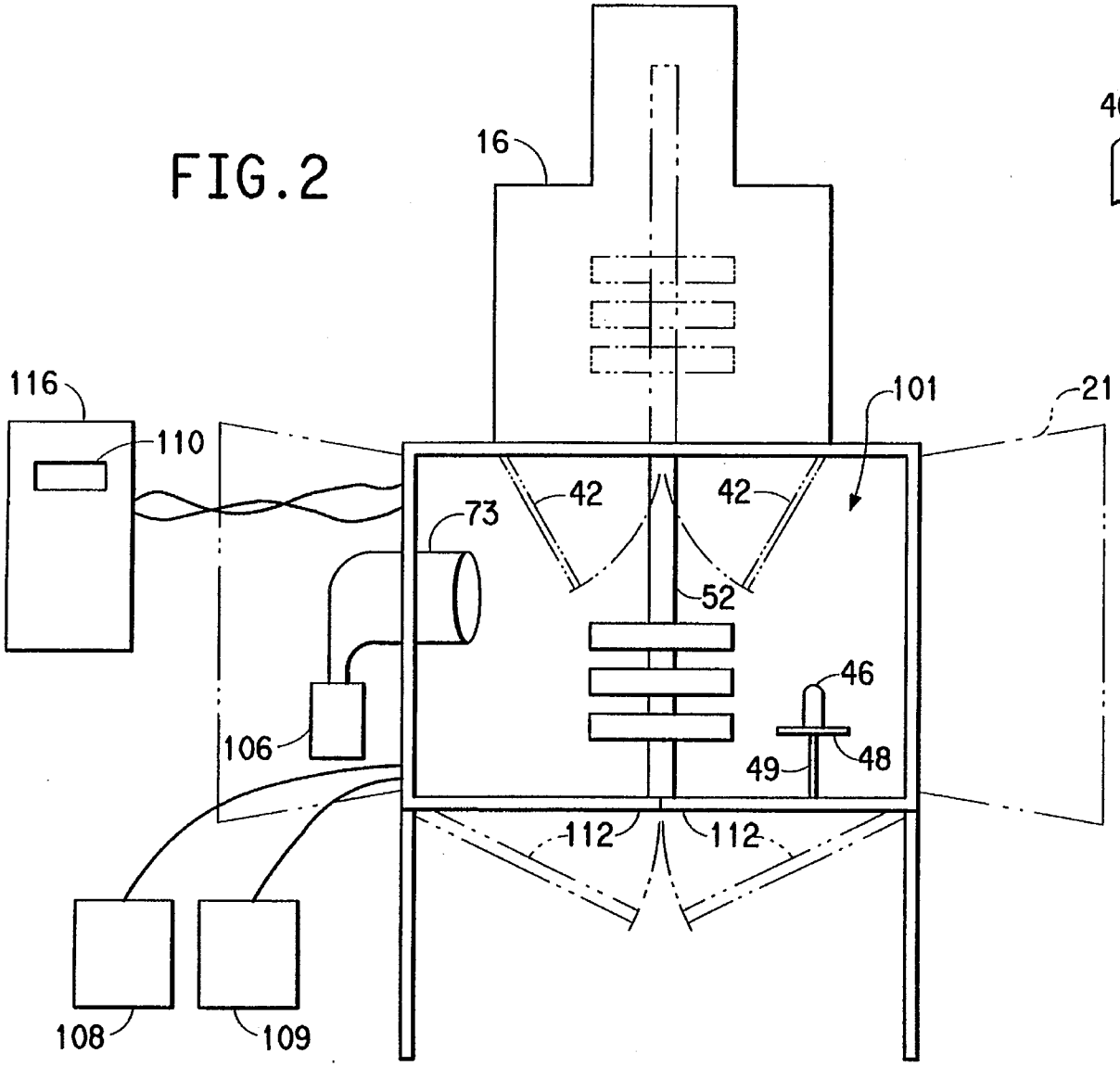
FIG. 2 is a schematic representation of the inner compartment of the present invention.

The operator enters spray booth 100 by opening hinged doors 21, lifting filter/diffuser frame assembly 20, and raising floor plates 112. This allows access to spray gun assembly 70. The operator deactivates the atomization air to spray gun 46 and positions spray gun 46 in front of emissions reduction attachment 73, shown in FIG. 2. Spray gun 46 is purged with basecoat paint, followed by basecoat wash liquid, to ensure that paint fluid lines from basecoat paint pot 108 to a three way fluid valve, not shown, which connects with spray gun 46, are flooded. The operator then reactivates the atomization air to spray gun 46. As shown in FIG. 2, the paint and wash liquid used to purge spray gun 46 is collected in emissions reduction attachment 73 mounted at the side of spray booth cavity 101. Liquids entering into emission reduction attachment 73 drain to storage container 106 located outside spray booth 100.

This purge procedure decreases the amount of material which goes into the air stream within spray booth cavity 101 and ultimately either onto paint arrestor 32 or into exhaust air handling system 80. The useful life of paint arrestor 32 is thereby prolonged. Spray emissions device 73 also decreases the quantity of vapors being discharged, leading to significant reductions in airborne emissions.

The operator commands panel support frame 52 to be lowered into spray booth cavity 101 and attaches test panels onto panel support frame 52. Floor plates 112 are then closed, and the filter/diffuser frame assembly 20 is returned to its down position. Booth doors 21 are closed by any conventional latching means. This purging sequence can be automated and controlled by an attached computer as an alternative to the described manual procedure.

Using control panel 110 the operator selects a preprogrammed spray procedure from the control computer screen menu.

The automatic spraying and baking cycle begins by elevating panel support frame 52 into oven assembly 16 by vertical indexing assembly 35. Oven flap doors 42 are closed. Spray gun 46 is positioned relative to emissions control attachment 73. The computer deactivates the atomization air to spray gun 46. Paint from basecoat pressure pot 108 or other storage container is channeled to spray gun 46 and sprayed into emissions control attachment 73. Spray gun 46 is indexed to the spray cycle start position by the computer. Panel support frame 52 is then descended into spray booth cavity 101 and oven flap doors 42 are again closed.

Spray panels, not shown, attached to panel support frame 52 are sprayed using conventional spray methods. Spray gun 46 is traversed horizontally across spray booth cavity 101 at a predetermined velocity. Panel support frame 52 is indexed vertically during a period of interpass dwells by vertical indexing assembly 35. The computer software is programmed to allow multiple coats of paint to be sprayed per panel. A second spray gun may be attached to horizontal gun bar 48 for clearcoat spray over a basecoat.

Between successive sprayouts, the paint on panels attached to panel support frame 52 is allowed to flash in booth cavity 101. Solvent-laden air is exhausted through air handling system 80. After the final basecoat is sprayed onto panels attached to panel support frame 52, the coating is allowed to flash. Oven flap doors 42 are then opened and panel support frame 52 is indexed vertically upward by vertical indexing assembly 35 into oven assembly 16. Oven flap doors 42 are then closed. Spray gun 46 is positioned relative to emissions reduction attachment 73 with the atomization air deactivated and purged with wash solution from wash solution pressure pot 109 or other storage container. All wash liquid is ejected into emissions control attachment 73 for collection. A Type X purge is conducted within oven assembly 16 upon completion of the purge cycle prior to energizing heater element 17 within oven 16 to eliminate any flammable vapors within oven assembly 16.

Oven assembly 16 contains a feed-back controlled infrared radiant heater element 17. A temperature sensor, not shown, consists of a pair of thermocouples mounted on a plate which has a Commission Internationale de L'Eclairage (CIE) color lightness value L of approximately 50 color units. This plate is located on the same plane of the elevated sprayed panels to mimic the heat buildup of panels attached to panel support frame 52. When the sprayed panels have reached a pre-selected bake temperature, the computer-controlled bake cycle begins for a pre-determined bake time.

At completion of the bake cycle, power to heater element 17 is terminated and heater element 17 is allowed to cool. Oven flap doors 42 open when the surface temperature of heater element 17 drops below 80 percent of the auto ignition point for a Group C electrically classified environment material as defined by The National Electrical Code.

Air jets, not shown, are energized within oven chamber 47 to expedite the cool down of the DYMATROL® mechanical drive tape track. When the DYMATROL® mechanical drive tape track is sufficiently cool, such that Dymatrol® mechanical drive tape 26 will not be damaged by elevated temperatures, and when heater tubes 17 are sufficiently cool, panel support frame 52 is lowered into spray booth cavity 101 for a clearcoat spray cycle.

If clearcoat spraying is to be done, a clearcoat gun, not shown, is positioned relative to emissions reduction attachment 73 and purged with clearcoat material from a pressurized pot or other container containing clearcoat material. Panel support frame 52 with the panels to be sprayed is then lowered into spray booth cavity 101.

The spray cycle will be repeated, utilizing spray parameters unique to the material being sprayed onto the panels. Panel support frame 52 is indexed vertically into oven 16 upon completion of the spray cycle and oven flap doors 42 are closed. A clearcoat gun, not shown, is positioned relative to emissions reduction attachment 73 and purged with clearcoat wash liquid.

A Type X purge is conducted within the oven prior to engaging heater element 17 within oven assembly 16. Time and temperature of the clearcoat bake cycle must be optimized for the particular material sprayed, and is not necessarily the same parameters as those used for the basecoat bake cycle.

Upon completion of the clearcoat bake cycle, including the cooldown cycle of oven assembly 16, panel support frame 52 is vertically indexed downward into spray booth cavity 101. When the panels are sufficiently cool, the operator removes the panels from the test panel support frame and completes color analysis upon the test panels. Surplus basecoat and clearcoat coatings are removed from their respective pressure pots. Wash liquid can be used to clear the process lines.

The invention can be used to spray both solvent-based as well as water-based coatings. The interior of spray booth 100 is electrically classified as Class I, Division I, Group C and can be installed in a Class I, Division 2, Group C environment. Oven assembly 16 is rated General and is cleared of vapors prior to the start of any heated bake cycle.

What is claimed is:

1. A spray booth enclosing a spraying zone and a separate baking zone having entry means for introducing a panel into said booth and means for vertically positioning said panel in said booth, a spray gun mounted in said spraying zone and infrared heating elements mounted in said separate baking zone, wherein said baking zone is atmospherically isolated from said spraying zone when said heating elements are activated;

means for moving said spray gun relative to said panel to apply at least one programmed spray coating to said panel, means for advancing a coated panel directly from said spraying zone into said baking zone, said spray gun and said heating elements being programmed to automatically perform spraying and baking cycles, wherein, prior to activating said heating elements, said baking zone has an air pressure which is greater than the air pressure of said spraying zone; and computer means for controlling coating flow to said gun and for actuating monitoring and correcting parameters of movement and coating flow to said gun and movement of said panel within said spray booth.

2. A device of claim 1 in which said computer system has a keyboard with display means, wherein procedures and parameters can be programmed into said computer system by using said keyboard.

3. A device of claim 1 in which said computer system is programmed to provide separate spray parameters for the coating being applied by the device.

4. A device of claim 1 which includes a collecting chamber into which a coating composition can be sprayed from said spray gun for collection outside of said spray chamber.

5. The device of claim 1 in which there is a plurality of spray guns.

6. The device of claim 1 having means attached to said spray booth for supplying air into said device at a sufficient flow and pressure so that the air concentration of flammable materials within said device is sufficiently low such that said device can be operated within an environment which is electrically classified as hazardous.

7. The device of claim 1 in which a porous material which captures overspray from said gun is located in proximity to an air outlet of said spray booth.

8. A device of claim 1 in which a porous material is located in proximity to an air inlet within said spray booth to diffuse air coming into said spray booth by means supplying air to said air inlet.

9. The device of claim 1 wherein the air pressure within said baking zone is maintained at a level higher than the air pressure of the air within said spraying zone, and the air pressure maintained within said spraying zone is maintained at a level lower than the air pressure of the air outside said device, such that flammable vapors are contained within said spraying zone.

10. The device of claim 1 wherein said baking zone comprises infrared heating elements with temperature sensing means for feed-back control of a heating cycle.

11. The device of claim 10 wherein said temperature sensing means are mounted on a plate having the same plane orientation of a sprayed panel and having a color lightness value of about 50 color units.

* * * * *